US008843036B2

(12) United States Patent
Chang

(10) Patent No.: US 8,843,036 B2
(45) Date of Patent: Sep. 23, 2014

(54) DOCTOR BLADE FOR IMAGE FORMING DEVICE

(76) Inventor: Dong Hyuk Chang, Goyang-si (KR)

( * ) Notice: Subject to any disclaimer, the term of this patent is extended or adjusted under 35 U.S.C. 154(b) by 0 days.

(21) Appl. No.: 13/810,189

(22) PCT Filed: Oct. 8, 2010

(86) PCT No.: PCT/KR2010/006884

§ 371 (c)(1),
(2), (4) Date: Jan. 14, 2013

(87) PCT Pub. No.: WO2012/026648

PCT Pub. Date: Mar. 1, 2012

(65) Prior Publication Data

US 2013/0164046 A1 Jun. 27, 2013

(30) Foreign Application Priority Data

Aug. 24, 2010 (KR) ..... 10-2010-0081907

(51) Int. Cl.
*G03G 15/08* (2006.01)

(52) U.S. Cl.
CPC ..... *G03G 15/0812* (2013.01)
USPC ..... 399/284

(58) Field of Classification Search
CPC ..... G03G 15/0812
USPC ..... 399/274, 284
See application file for complete search history.

(56) References Cited

U.S. PATENT DOCUMENTS 5,085,171 A 2/1992 Aulick et al.
5,097,294 A * 3/1992 Nishio et al. ..... 399/284
5,655,197 A * 8/1997 Okada et al. ..... 399/281
5,797,076 A 8/1998 Bracken et al.
6,049,689 A * 4/2000 Ishii et al. ..... 399/284
2009/0232540 A1 * 9/2009 Shanun et al. ..... 399/103

FOREIGN PATENT DOCUMENTS

JP 05-188760 A 7/1993
JP 11-073014 A 3/1999
KR 1998-086925 12/1998
KR 1999-0040036 11/1999
KR 10-2007-0064168 A 6/2007
KR 10-2008-0069286 A 7/2008

* cited by examiner

*Primary Examiner* — Sandra Brase

(74) *Attorney, Agent, or Firm* — IM IP Law PLLC; C. Andrew Im

(57) ABSTRACT

A doctor blade of an image forming device for controlling a thickness of a toner coated on a development roller to a uniform thickness inside the image forming device is disclosed. The doctor blade includes: a support rod serving as a support fixture; a plate formed in an L shape, the plate being mounted on the lower surface and the rear surface of the support rod in contact with them to thereby serve to keep a uniform thickness of the toner in a state where the bottom surface is in contact with the development roller, the plate including a base layer of a metallic material and a coated layer formed on the bottom surface of the base layer getting in contact with the development roller; and a torsion spring mounted above the support rod to pressurize the support rod and the plate in order to fix the support rod and the plate. The doctor blade is reusable because only the plate is simply replaced with a new one when the coated layer formed on the plate is worn out.

5 Claims, 6 Drawing Sheets

DOCTOR BLADE FOR IMAGE FORMING DEVICE

RELATED APPLICATIONS

The present application is a §371 national stage application from International Application PCT/KR2010/006884, with an International Filing Date of Oct. 8, 2010, which claims priority from Korean Patent Application No. 10-2010-0081907 filed Aug. 24, 2010, each of which is incorporated herein by reference in its entirety.

FIELD OF THE INVENTION

The present invention relates to a doctor blade of an image forming device, and more particularly, to a doctor blade of an image forming device for controlling a thickness of a toner coated on a development roller to a uniform thickness inside the image forming device.

BACKGROUND OF THE INVENTION

FIG. 1 is a configurative diagram of a general image forming device.

As shown in FIG. 1, the image forming device includes: a toner loading part 2 for loading a toner 1; a stirrer 3 mounted inside the toner loading part 2 for stirring the toner 1; a supply roller 4 mounted below the toner loading part 2 for transferring the stirred toner 1 to a development roller; the development roller 5 for developing the toner 1, which is transferred from the supply roller 4, into an electrostatic latent image formed on the surface of a photoconductive drum; a doctor blade 6 mounted on the development roller 5 for controlling the toner 1 formed on the surface of the development roller 5 to a uniform thickness; the photoconductive drum 7 mounted at one side of the development roller 5 and rotating at uniform peripheral speed; and a cleaning blade 8 being in contact with one side of the photoconductive drum 7.

Moreover, the image forming device further includes: a light exposure part 9 mounted at an upper end portion of one side of the photoconductive drum 7 for forming the electrostatic latent image on the surface of the photoconductive drum 7 charged electrically; an electric charge roller 10 mounted at an upper end portion of the other side of the photoconductive drum 7 for electrically charging a charge layer uniformly on the surface of the photoconductive drum 7; and a transfer roller 11 mounted at a lower end portion of the photoconductive drum 7 for transferring a toner image of the surface of the photoconductive drum 7 onto paper (P).

An operation of the image forming device will be described as follows.

First, the toner 1 loaded on the toner loading part 2 is stirred by the stirrer 3, moved toward the supply roller 4, and is supplied to the development roller 5 by a rotation of the supply roller 4.

Next, the surface of the photosensitive drum 7 is electrically uniformly charged by an electric action of the electric charge roller 10. Additionally, when the electrically charged part by the rotation of the photoconductive drum 7 receives an electric signal for forming an image through the light exposure part 9 and exposes the surface of the photoconductive drum 7, the light-exposed part forms an electrostatic latent image in an initially electrically charged state. In this instance, the electrostatic latent image of the photoconductive drum 7 is developed to the toner 1 and changed into a visible image while passing the development roller 5. Finally, the paper (P) mounted on a feeding cassette is fed by a feeding roller (not shown in the drawings), and then, the toner image of the surface of the photoconductive drum 7 is transferred to the paper (P) by a high pressure action of the transfer roller 11.

In the meantime, in the case of the image forming device, the quality of the image is dependent on how uniformly the thickness of the toner on the development roller is controlled to the doctor blade. Accordingly, because the doctor blade is rotated in contact with the development roller, the doctor blade is designed in consideration of durability, wear resistance, and others by a friction force, and there are many attempts to develop doctor blades having superior functions.

FIG. 2 is a perspective view of a doctor blade according to a prior art, and FIG. 3 is a sectional view showing a state where the doctor blade according to the prior art is mounted on a development roller.

As shown in the drawings, the doctor blade includes: a support member 20 for locating a blade adjacent to a development roller 5; an elastic layer 30 attached to the support member 20; and a shim 40 joined with the elastic layer 30, the shim in which a polyester layer 41 getting in contact with the development roller 5 and a conductive abrasive material layer 42 are laminated. Furthermore, the support member 20 and the elastic layer 30, and the elastic layer 30 and the shim 40 are adhered with each other by adhesive tapes 50 and 60.

However, the above-mentioned doctor blade has the following problems.

First, the shim 40 has a problem in that the quality of image is deteriorated because it is pushed forward and sprung forth by a rotary force of the development roller 5 as time goes by.

Second, because the adhesive tape 50 between the support member 20 and the elastic layer 30 and the adhesive tape 60 between the elastic layer 30 and the shim 40 may get softened or hardened due to a change in physical property and the thickness may be changed, it is difficult to uniformly control the thickness of the toner.

Third, the whole of the doctor blade assembly must be replaced with a new one when the abrasive material layer 42 of the shim 40 is abraded.

SUMMARY OF THE INVENTION

Accordingly, the present invention has been made to solve the above-mentioned problems occurring in the prior arts, and it is an object of the present invention to provide a doctor blade of an image forming device, which can prevent that a member getting in contact with a development roller is pushed forward and sprung forth by the development roller, uniformly control the entire thickness of a toner, and is reusable by replacing just a wanted part with a new one.

To achieve the above objects, the present invention provides a doctor blade of an image forming device for controlling a thickness of a toner coated on a development roller to a uniform thickness inside the image forming device, the doctor blade including: a support rod serving as a support fixture; a plate formed in an L shape, the plate being mounted on the lower surface and the rear surface of the support rod in contact with them to thereby serve to keep a uniform thickness of the toner in a state where the bottom surface is in contact with the development roller, the plate including a base layer of a metallic material and a coated layer formed on the bottom surface of the base layer getting in contact with the development roller; and a torsion spring mounted above the support rod to pressurize the support rod and the plate in order to fix the support rod and the plate.

Here, a plurality of the torsion springs are mounted at several positions.

Moreover, the support rod is made of polycarbonate, and the base layer of the plate is made of plastic or metal.

Furthermore, tension of the torsion spring is controlled to regulate the thickness of the toner coated on the development roller.

The doctor blade of the image forming device according to the present invention can control the entire thickness of the toner to a uniform thickness without any change in temperature because the L-shaped plate applied as the member getting in contact with the development roller is firmly supported to the support rod not to be sprung forth by the rotation of the development roller and is fixed with the support rod just by the torsion spring. Furthermore, the doctor blade is reusable because only the plate is simply replaced with a new one when the coated layer formed on the plate is worn out.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE EMBODIMENTS

Reference will be now made in detail to the preferred embodiment of the present invention with reference to the attached drawings.

Figure 1:
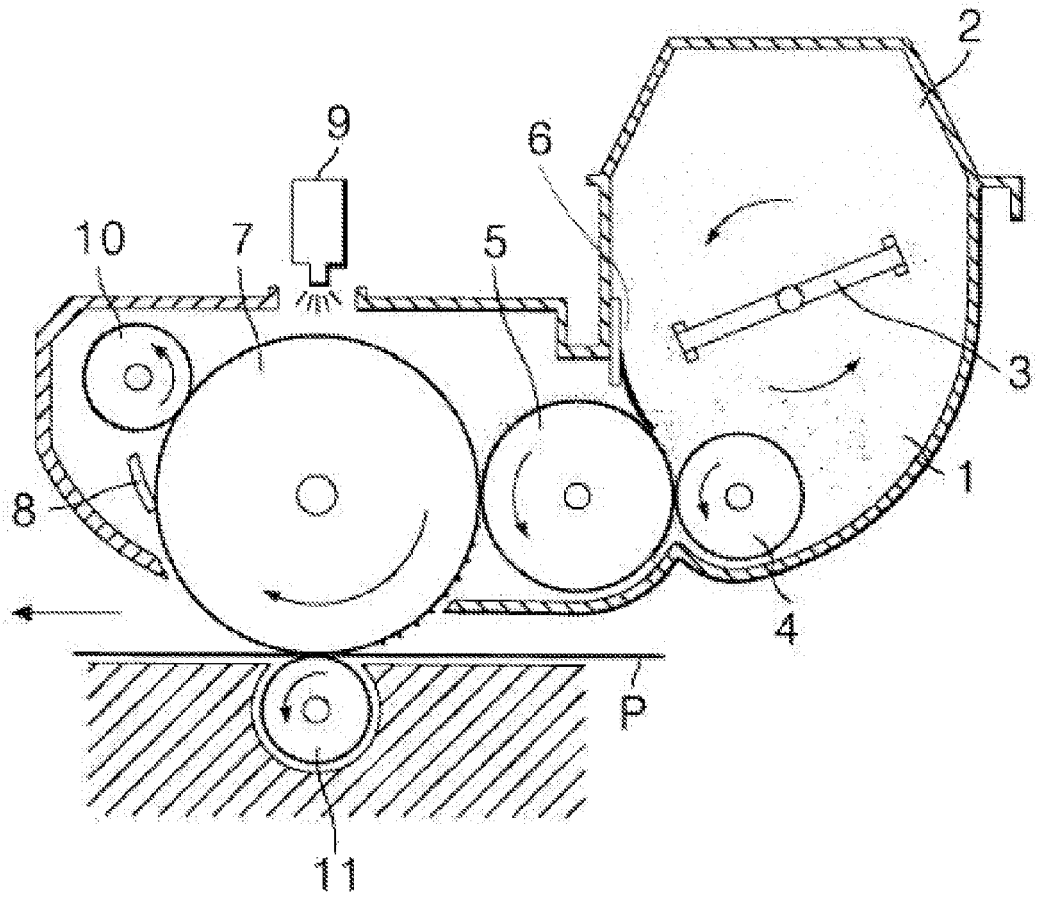
FIG. 1 is a configurative diagram of a general image forming device.
Figure 2:
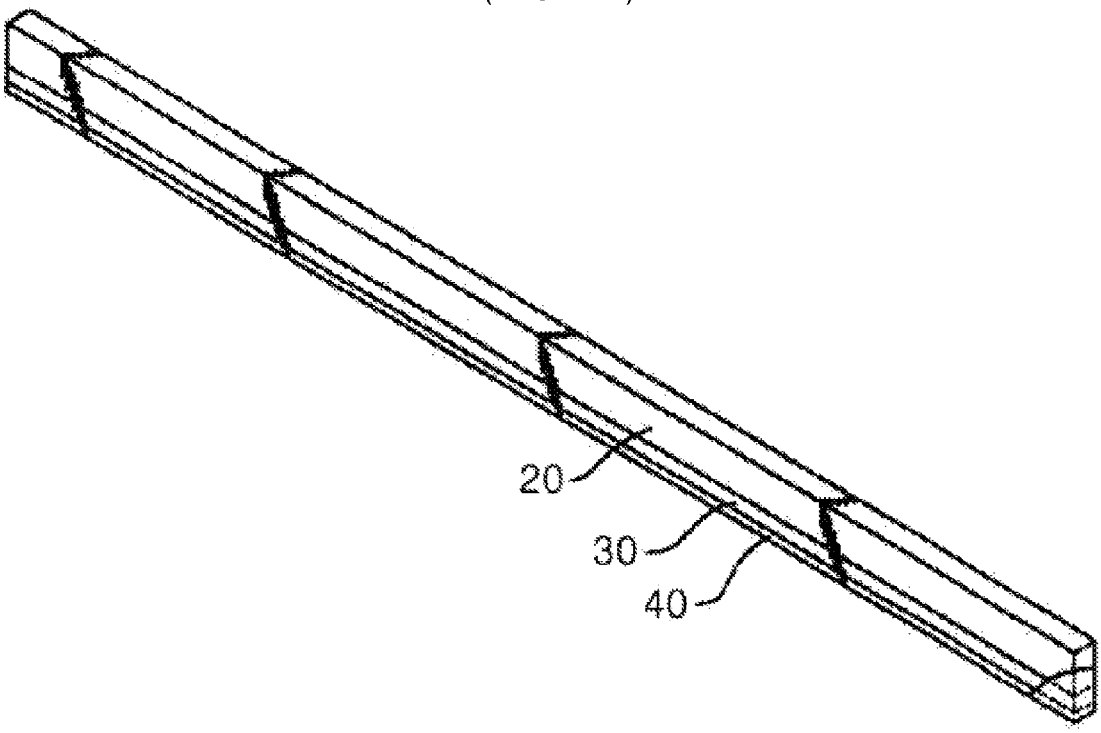
Fig. 2 (PRIOR ART)
FIG. 2 is a perspective view of a doctor blade according to a prior art.
Figure 3:
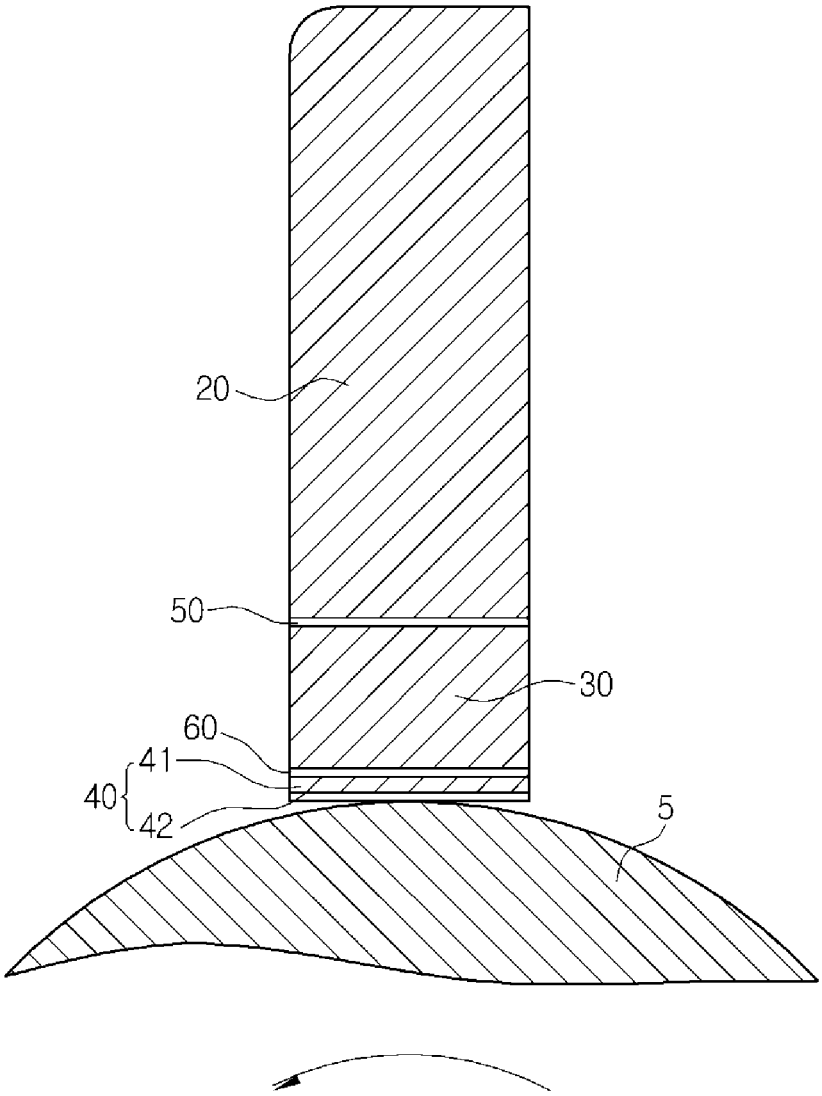
Fig. 3 (PRIOR ART)
FIG. 3 is a sectional view showing a state where the doctor blade according to the prior art is mounted on a development roller.
Figure 4:
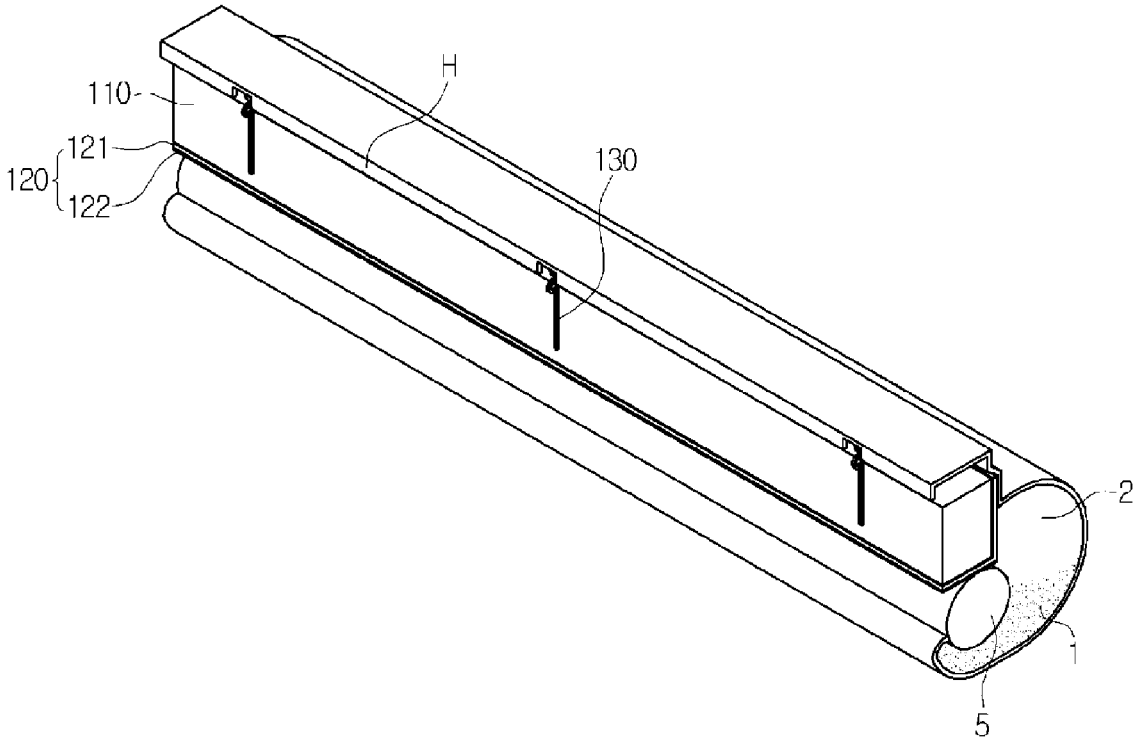
FIG. 4 is a perspective view of a doctor blade according to the present invention.
Figure 5:
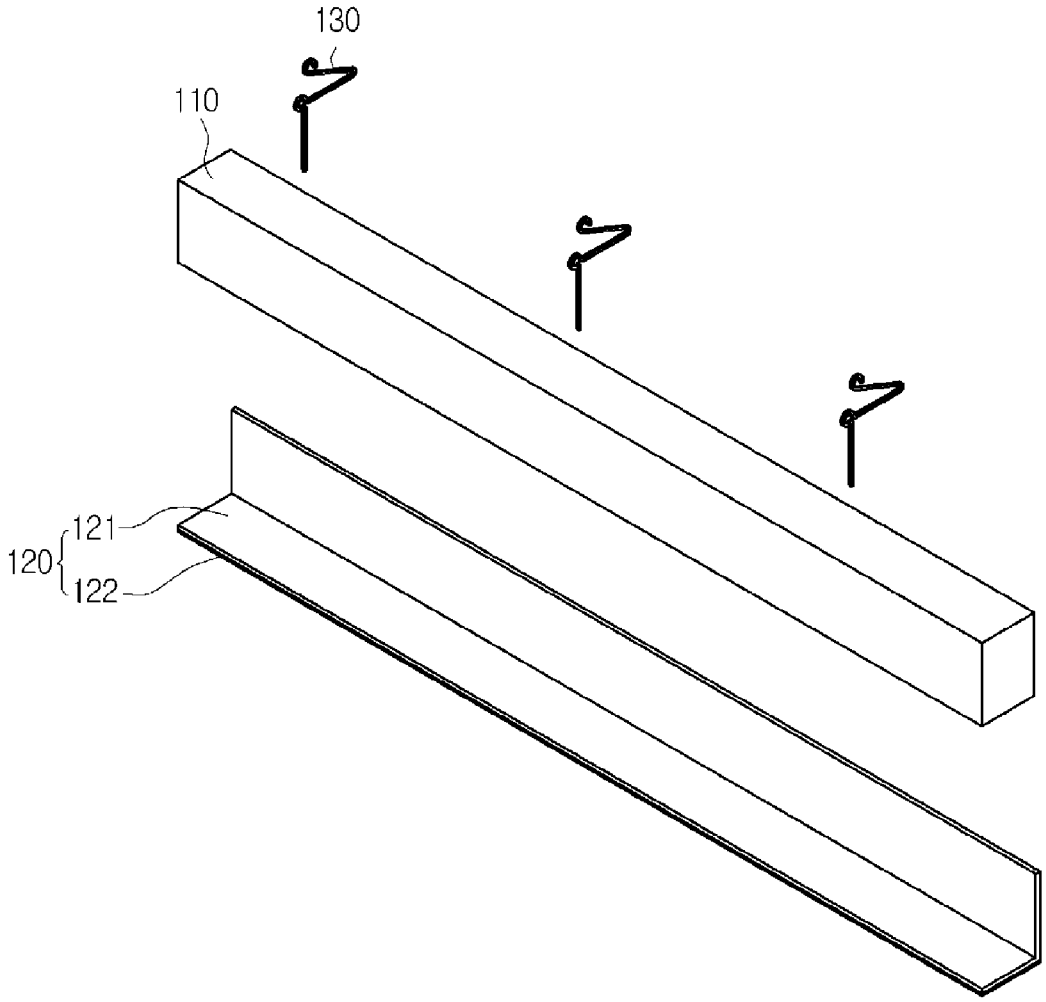
FIG. 5 is an exploded perspective view of the doctor blade according to the present invention.
Figure 6:
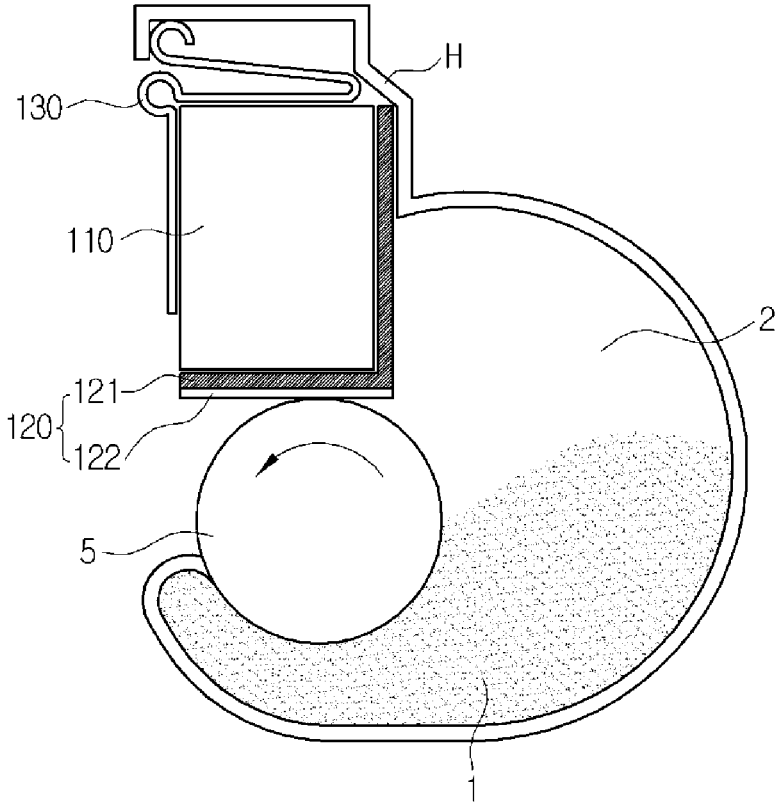
FIG. 6 is a sectional view showing a state where the doctor blade according to the present invention is mounted on a development roller.

FIG. 4 is a perspective view of a doctor blade according to the present invention, FIG. 5 is an exploded perspective view of the doctor blade according to the present invention, and FIG. 6 is a sectional view showing a state where the doctor blade according to the present invention is mounted on a development roller.

As shown in the drawings, the doctor blade of an image forming device according to the present invention is to control a thickness of a toner coated on a development roller to a uniform thickness, and includes a support rod 110, a plate 120, and a torsion spring 130.

The support rod 110 is made of a polycarbonate material with flexural rigidity of about 850 kg/cm$^2$, and serves as a support fixture.

The plate 120 is in an L shape, and may be made of plastic (including a film) or metal such as stainless steel. The plate 120 is mounted on the lower surface and the rear surface of the support rod 110 in contact with them and serves to keep a uniform thickness of the toner in a state where the bottom surface is in contact with the development roller 5 under a uniform pressure. As described above, because the L-shaped plate is firmly supported by the support rod 110, it is not pushed forward and sprung forth by the rotation of the development roller 5. Accordingly, because the plate 120 gets in contact stably as it was mounted and positioned initially, the quality of image is maintained uniformly.

Furthermore, the plate 120 includes a base layer 121 of a metallic material, and a coated layer 122 formed on the bottom surface of the base layer 121 getting in contact with the development roller 5. In this instance, the coated layer 122 is not restricted in its material if the material has good durability and wear resistance and can make fluidity of the toner good. The coated layer 122 can effectively protect the surface of the development roller 5 when the plate 120 gets in contact with the development roller 5. In addition, the coated layer 122 can always keep a flow of the toner uniformly and prevent that the toner lumps even at them time of a stop of the development roller 5.

The torsion spring 130 is to firmly fix the support rod 110 and the plate 120 with each other without using adhesive tapes, and is mounted above the support rod 110 to pressurize the support rod 110 and the plate 120. In other words, in order to pressurize and fix the support rod 110 and the plate 120, one end of the torsion spring 130 for showing elasticity is fit into to a hole formed in a housing (H) of the image forming device and the other end of the torsion spring 130 is located and mounted at the front surface of the support rod 110.

As described above, the support rod 110 and the plate 120 are firmly fixed by the torsion spring 130, so that the plate 120 is not pushed and sprung forth by the development roller 5 and can uniformly control the entire thickness of the toner.

In order to fix the support rod 110 and the plate 120 more firmly, a plurality of the torsion springs 130 of the image forming device according to the present invention may be mounted at several positions at regular intervals between the housing (H) and the support rod 110.

Moreover, the doctor blade of the image forming device according to the present invention can properly control the thickness of the toner coated on the development roller 5 by controlling tension of the torsion spring 130. That is, if tension of the torsion spring 130 is strong, because pressure of the torsion spring 130 to the support rod 110 and the plate 120 increases and a contact force between the coated layer 122 of the plate 120 and the development roller 5 is also increased, the doctor blade can control the thickness of the toner to become thinner. On the contrary, if tension of the torsion spring 130 is weak, because pressure of the torsion spring 130 to the support rod 110 and the plate 120 decreases and the contact force between the coated layer 122 of the plate 120 and the development roller 5 is also decreased, the doctor blade can control the thickness of the toner to become thicker.

Hereinafter, an action of the doctor blade of the image forming device according to the present invention will be described.

First, in a state where the L-shaped plate 120 is mounted on the lower surface and the rear surface of the support rod 110 in contact with them, the torsion spring 130 is interposed between the support rod 110 and the housing (H) of the image forming device, so that the doctor blade is mounted in a state where it applies a uniform pressure to the development roller 5.

Furthermore, when the image forming device is operated to rotate the development roller 5, the toner 1 loaded on the toner loading part 2 is supplied, and the toner 1 formed on the surface of the development roller 5 is controlled into a uniform thin layer by the coated layer 122 of the plate 120.

In this instance, because the L-shaped plate 120 is firmly fixed to the support rod 110, it is not pushed forward by the rotation of the development roller 5. Additionally, because the support rod 110 and the plate 120 are fixed just by the torsion spring 130, the doctor blade can always control the thickness of the toner uniformly without regard to changes in temperature and others. Therefore, the doctor blade can always keep a good quality of images. In addition, if the coated layer 122 formed on the plate 120 is worn out due to a long-term use, the doctor blade is reusable when a user disassembles the torsion spring 130 and simply assembles it after replacing only the plate 120.

In the meantime, a limited embodiment of the doctor blade of the image forming device according to the present invention is described in the specification, but the scope of the present invention is not restricted to the specific embodiment, and it will be understood by those of ordinary skill in the art that various alternatives, changes and modifications may be made therein within the scope of the invention.

Accordingly, the exemplary embodiment and attached drawings of the present invention are not to limit the technical idea of the present invention but are to describe the present invention, and hence, the scope of the technical idea of the present invention is not limited by the exemplary embodiment and the attached drawings. Therefore, it should be understood that the scope of the present invention is interpreted by the following claims and all technical ideas in equivalent scopes belong to the scope of the present invention.

What is claimed is:

1. A doctor blade of an image forming device for controlling a thickness of a toner coated on a development roller to a uniform thickness inside the image forming device, the doctor blade comprising:

a support rod serving as a support fixture;

a plate formed in an L shape, the plate being mounted on the lower surface and the rear surface of the support rod in contact with them to thereby serve to keep a uniform thickness of the toner in a state where the bottom surface is in contact with the development roller, the plate including a base layer of a metallic material and a coated layer formed on the bottom surface of the base layer getting in contact with the development roller; and a torsion spring mounted above the support rod to pressurize the support rod and the plate in order to fix the support rod and the plate.

2. The doctor blade according to claim 1, wherein a plurality of the torsion springs are mounted at several positions.

3. The doctor blade according to claim 1, wherein the support rod is made of polycarbonate.

4. The doctor blade according to claim 1, wherein the base layer of the plate is made of plastic or metal.

5. The doctor blade according to claim 1, wherein tension of the torsion spring is controlled to regulate the thickness of the toner coated on the development roller.

* * * * *